US005628090A

United States Patent [19]

Lock

[11] Patent Number: 5,628,090

[45] Date of Patent: May 13, 1997

[54] APPARATUS FOR THE PRODUCTION OF ABSORBENT MATERIALS

[76] Inventor: Peter M. Lock, 2209 Glenalden East, Germantown, Memphis, Tenn. 38139

[21] Appl. No.: 465,517

[22] Filed: Jun. 1, 1995

Related U.S. Application Data

[62] Division of Ser. No. 316,941, Oct. 3, 1994, Pat. No. 5,596,031, and Ser. No. 903,904, Jun. 25, 1992, Pat. No. 5,382,609.

[30] Foreign Application Priority Data

Jun. 26, 1991 [GB] United Kingdom ..... 0/911361

[51] Int. Cl.[6] ..... D01G 25/00; D01G 27/00; B06B 1/02; B28B 17/00

[52] U.S. Cl. ..... 19/304; 19/296; 264/DIG. 75; 264/405; 425/174.8 E; 425/7

[58] Field of Search ..... 524/35, 43, 45, 524/72; 427/180; 156/283; 264/24, DIG. 75; 19/304, 296; 425/174.8 E, 7; 55/528

[56] References Cited

U.S. PATENT DOCUMENTS

| | | | |
|---|---|---|---|
| 2,686,141 | 8/1954 | Sawyer | 154/101 |
| 2,810,426 | 10/1957 | Till et al. | 154/27 |
| 2,988,469 | 6/1961 | Watson | 154/101 |
| 3,275,496 | 9/1966 | Sponsel | 162/101 |
| 3,622,422 | 11/1971 | Newman | 156/306 |
| 3,813,466 | 5/1974 | Anderson | 424/28 |
| 4,166,464 | 9/1979 | Korpman | 128/287 |
| 4,646,730 | 3/1987 | Schonfeld et al. | 728/156 |
| 4,702,947 | 10/1987 | Pall et al. | 428/36 |
| 4,705,809 | 11/1987 | Dighton et al. | 521/61 |
| 5,063,492 | 11/1991 | Miller | 424/445 |
| 5,064,492 | 11/1991 | Friesch | 156/191 |
| 5,382,609 | 1/1995 | Lock | 524/35 |

FOREIGN PATENT DOCUMENTS

| | | |
|---|---|---|
| 427362 | 8/1972 | Australia . |
| 0007149 | 1/1980 | European Pat. Off. . |
| 0470594 | 2/1992 | European Pat. Off. . |
| 2031720 | 11/1970 | France . |
| 2031719 | 11/1970 | France . |
| 1259085 | 1/1972 | France . |
| 1259084 | 1/1972 | France . |
| 2416535 | 8/1979 | France . |
| 827641 | 2/1960 | United Kingdom . |
| 2015253 | 9/1979 | United Kingdom . |
| 2115702 | 9/1983 | United Kingdom . |
| WO81/0326 | 11/1981 | WIPO . |

*Primary Examiner*—Paul R. Michl
*Assistant Examiner*—LaVonda R. DeWitt

[57] ABSTRACT

The present invention relates to an apparatus for the production of absorbent materials comprising fibers cross-linked by a suitable cross-linker therefor, and wherein said cross-linker is associated with substantially the entire surface of each fiber, said materials being preparable by mixing of an aerated suspension of the charged fibers with the cross-linker before heating and compressing, such fibers having a capacity for fluid absorption considerably greater than has been heretofore known for such materials.

1 Claim, 1 Drawing Sheet

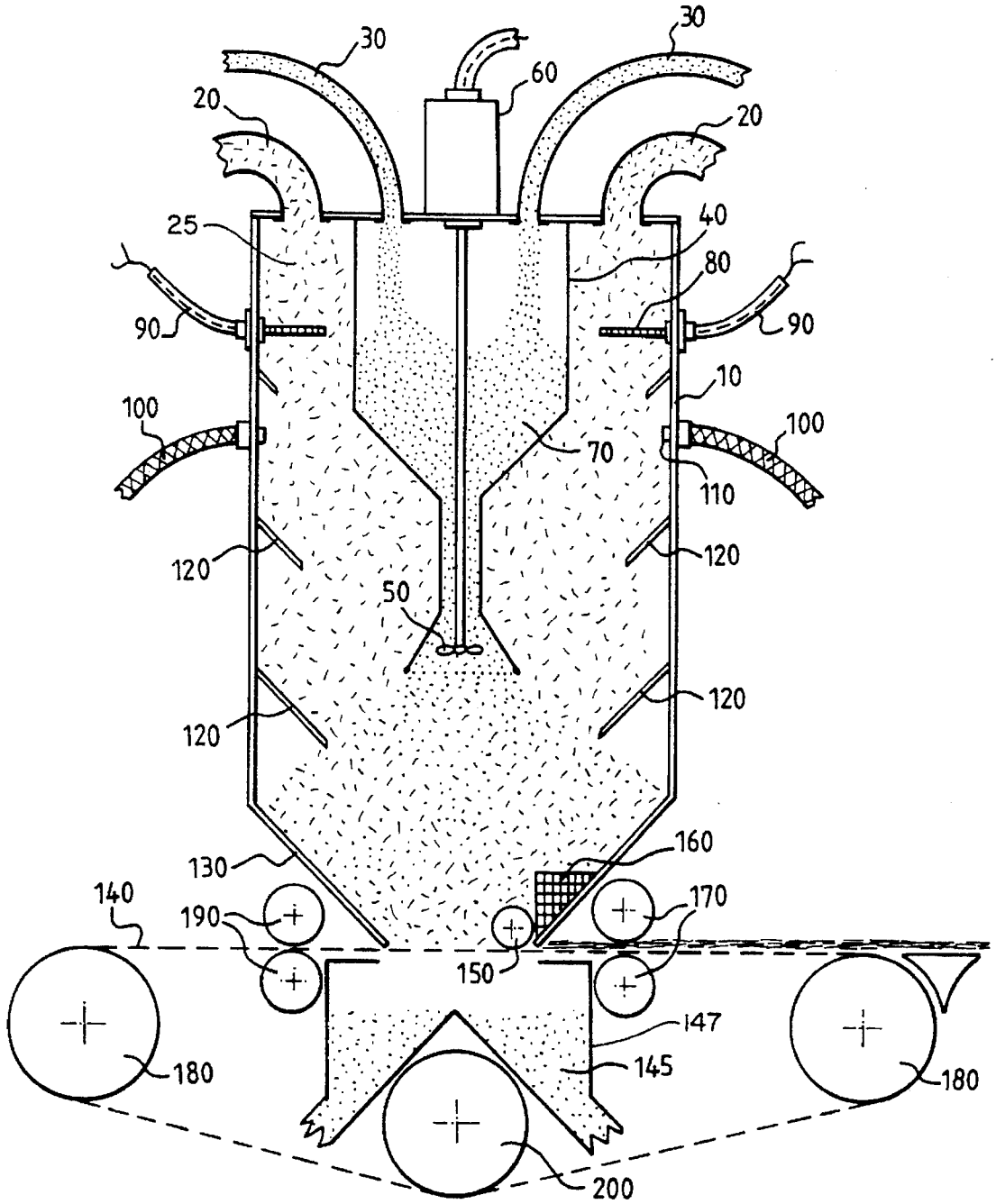
30
30
60
20
20
25
40
80
90
90
10
100
100
70
110
120
120
50
120
120
130
160
140
190
170
150
147
145
180
180
200

APPARATUS FOR THE PRODUCTION OF ABSORBENT MATERIALS

This application is a divisional application of U.S. patent application Ser. No. 08/316,941, filed Oct. 3, 1994 and of application Ser. No. 07/903,904 filed Jun. 25, 1992, now U.S. Pat. No. 5,382,609.

FIELD OF THE INVENTION

The present invention relates to sheets of fibrous material, especially comprising cellulosic fibers, which are absorbent for aqueous liquids.

DESCRIPTION OF THE PRIOR ART

There is great demand for materials which are capable of absorbing quantities of liquid, while remaining substantially solid, and which, before use, are compact. Examples of uses for such materials include kitchen rolls, sanitary pads, nappies, plasters and wound dressings in general.

Suitable materials are generally available, but which do not necessarily fulfil all of the requirements. For example, sanitary pads may be too bulky or too solid, and surgical dressings do not absorb a sufficient quantity of exudate from the wounds. An added complication is that, for applications involving contact with the human or animal body, especially a wound, it is highly desirable that there be no toxic compounds present in the dressing which may affect the body in any way. This is a particular disadvantage of many plastics.

Various materials are known which can be used for the above applications. Such materials include foamed plastics, absorbent paper and, more recently, sheets of cross-linked cellulosic fibers.

One advantage of the cross-linked cellulosic fibers is their non-toxicity, provided that the cross-linker is a suitable non-toxic compound, such as carboxymethyl cellulose. These materials also have the advantage of being able to absorb up to about one hundred times their own weight in water.

A primary disadvantage of the cross-linked cellulosic materials arises through the various methods of production available for them. This is essentially because of the difficulties involved in evenly distributing the cross-linker precursor throughout the fibers before effecting cross-linking. Two basic methods are known, the first of which is a dry process, and the second is a wet slurry process.

In the dry process, a layer of suitable cellulosic fibers is generated, such as by the air-felt process, followed by dredging a suitable powdered cross-linker onto the sheet and then compressing the whole, optionally after agitation, together with heating. It is generally necessary to use great pressure in order to effect any kind of satisfactory permeation of the cross-linker through the sheet, and the result is a very densely compressed sheet with variable concentrations of cross-linker throughout. These sheets tend to be least absorbent.

The alternative, wet process involves making a slurry of the cellulosic fibers and the cross-linker. This slurry is dried out and formed into a sheet, and then compressed and heated as before. This results in a more even distribution of the cross-linker throughout the material, but still does not form an optimal material with a particularly even density of cross-linker throughout, and also suffers from the drawback of being time consuming. The main problem is clumping with materials prepared from slurries, even where relatively low quantities of cross-linker are used.

SUMMARY OF THE INVENTION

It is an object of the present invention to provide an improved process for the production of cross-linked cellulosic fibrous materials, which process will ensure that the materials have an even and consistent density of cross-linker throughout, and which process will also not necessarily be limited to bibulous fibers, whether they be cellulosic or other.

It is also an object of the invention to provide absorbent materials of cross-linked fibers, preferably cellulosic fibers, which display superior absorption properties to the known materials.

It has now been discovered that the objects of the invention are readily achievable by mixing of an aerated suspension of statically charged fibers with the cross-linker before heating and compressing, the resulting materials having a capacity for fluid absorption considerably greater than has been heretofore known for such materials.

Thus, the present invention provides, in a first aspect, a process for the production of absorbent materials, comprising preparing a layer of fibers and a cross-linker therefor, and heating and compressing, in either order or together, the layer thereby prepared so as to effect cross-linking of the fibers, characterized in that, before preparation of the layer, the fibers and the cross-linker, both of which are essentially dry, and the cross-linker being in the form of a fine powder, are blended after either or both of the cross-linker and fibers has been electrically charged.

BRIEF DESCRIPTION OF THE DRAWING

The accompanying FIGURE shows apparatus suitable for the production of an absorbent layer of the invention.

DETAILED DESCRIPTION OF THE INVENTION

This process gives rise to an extremely even coating of cross-linker on the fibers, and the composite layer of fibers and cross-linker can then easily be compressed and heated to yield a superior end product. Furthermore, the process is extremely easy to use and effect, and is also cheap and quick, not requiring heavy compression rollers, or time consuming drying of a slurry.

A further advantage lies in the hygienic method of preparation of the product, as the constituents and process are essentially dry, thereby limiting the possibility of contamination.

In the process of the invention, it is generally preferred that the preparations are brought into admixture in a gaseous medium, preferably air.

Before compression, it is desirable to allow the mixture to settle into a layer after first bringing the preparations into admixture in a drum with agitation.

It is generally preferred that the fibers be suspended in air in a suitable container, such as a polyethylene or polypropylene drum, and charged. It is sufficient, for example, to merely provide a quantity of fibers in a polyethylene bag, to inflate the bag, and then to shake or agitate the bag so as to charge the fibers. Once this has occurred, the powdered cross-linker can be introduced to the bag and shaken again, after which the bag can be emptied onto a suitable surface, and the resulting layer heated and compressed.

On a larger scale, the fibers could be provided in a drum which, in turn, could be rotated until such time as the fibers therein were sufficiently charged. The cross-linker could then be introduced, with the drum rotated further, and then the mixture allowed to settle into the composite layer.

In a further aspect, the present invention provides apparatus for the production of absorbent materials from an essentially dry preparation of fibers and an essentially dry preparation of a powdered, heat activatable cross-linker for the fibers, the apparatus comprising a drum 10 having a top, a bottom and walls defining a cavity of the drum and having baffles 120, 160, as shown;

the top of the drum 10 having a first at least one opening 20 through which the fibers 25 can be introduced;

the top of the drum 10 having a second at least one opening 30 through which the cross-linker 70 can be introduced;

dividing means 40 being located between the first and the second openings, as shown, the dividing means 40 extending toward the bottom of the drum, and preferably forming a funnel;

electrical charging means 90 being provided on the wall of the drum 10 at a position below the first at least one opening 20 and above the lowest extent of the dividing means 40;

means 100, 110 for introducing gas under pressure being provided on the wall of the drum 10 at a position below the first at least one opening 20 and above the lowest extent of the dividing means;

means, such as a propellor or fan blade 50 driven by motor 60, as shown, to disperse the cross-linker and the fibers to form a dispersion when the cross-linker falls below the lowest extent of the dividing means 70;

the bottom 130 of the drum 10 defining an opening through which the dispersion can pass;

a fine mesh conveyor 145 being located beneath the bottom of the drum 10 to collect the dispersion conveyor 140 having drive and guide rollers 180, 200 and having nip rollers 170, 190, as shown;

collecting means 147 being disposed beneath the conveyor 140 to collect any excess cross-linker falling 195 through the conveyor;

means 150 to heat the dispersion after collection on the conveyor; and means 170 to compress the dispersion after collection on the conveyor, the heating and compressing means optionally being provided together in one or more rollers 170, for example.

The fibers may also be charged by other suitable means, such as providing charging plates directly linked to an electrical source, or by using ionizing radiation. It is also not necessary to suspend the fibers in air, especially if either of these latter two methods is used, and the powdered cross-linker can be introduced to the layer of fibers which then need only be agitated sufficiently to allow an even distribution of the cross-linker throughout the fibers, the electrical charge on the fibers serving to attract the cross-linker.

It is also not necessary for the fibers to be charged. It is possible for the powdered cross-linker to be charged instead, and then introduced to a suitable preparation of the fibers. Again, this may be a suspension in air, or may be a layer of fibers which are then agitated after the introduction of the cross-linker.

It is also possible to charge both the cross-linker and the fibers, but this is not required, and may possibly result in clumping of the cross-linker on the fibers if too much cross-linker is introduced.

It is also preferred to allow excess cross-linker to be separated from the composite layer before heating and compression. This may be effected by depositing the layer on a fine mesh, thereby allowing excess powder to fall through, and be collected for further processing if desired. The mesh itself may be agitated to assist loose powder to fall through, if desired. Owing to the charged nature of the layer and the powder, it may also be desirable to earth any container into which the powder falls. It is not so desirable for the mesh, as it may serve to prematurely discharge the composite layer, and allow the cross-linker to fall away from the fibers. In such an instance, an inferior product may be formed. However, it is generally the case that the charged condition of the composite layer exists for several minutes, allowing unhurried preparation of the layer for heating and compression before the charge wears off.

In some cases, it may be desirable to align the fibers in the material, and this may be achieved by any suitable means. One such means is by combing the material, such that the fibers must pass through a suitable array of slots, for example.

Other treatments of the composite layer may comprise spraying or immersion of the layer with water or any other, suitably aqueous, liquid, followed by drying which my be effected at the same time as the heating and compression. Such a treatment affects the end product, but is not usually desirable, unless, for example, the spray includes a dye, antiseptic or antibiotic. Even so, such substances may be added after cross-linking.

Before cross-linking, it may also be desirable to run the layer through a series of rollers, such as wet and dry heated rollers. Again, this affects the end product in a known manner.

Returning to the blending process, it is preferred to keep both cross-linker and the fibers as dry as possible, in order to maximize the effect of the electrical charge. To this extent, it may also be preferable to introduce a stream of warm dry air to displace humid air, or to dry the fibers and/or cross-linker. Further, it is not necessary that air is used, although if any other medium, such as an inert gas, or nitrogen, is used, then this will tend to raise the cost of production, and involve more expensive containment facilities. Nevertheless, use of such alternative media is envisaged by the present invention.

The present invention is particularly applicable to cellulosic fibers, but is not limited thereto. Any fibers may be used, provided that they are capable of being electrically charged. In particular, it is preferred that the fibers comprise polyhydric polymers, useful examples of which are naturally occurring structural polymers, particularly polysaccharides. Suitable examples include lignin, and especially cellulose.

It is not necessary that the fibers be bibulous, as it is generally envisaged that the majority of the absorption of the end product will be effected by the cross-linker matrix. However, it is preferred that the fibers be as fine as possible. This is for two reasons, the first being in order to avoid irritation where the material might come into contact with the human or animal body, and the second being to enhance the ability of the fibers to hold an electric charge. Nevertheless, it is envisaged that, provided that the fibers can hold an electric charge, then any gauge fibers may be used.

It is envisaged that, during the blending process, the powder of the cross-linker will evenly coat each individual fiber, subject to the amount of cross-linker present. Accordingly, it is preferred to prepare the cross-linker in such a manner that it forms a very fine dry powder. It is generally preferred that the mesh size of the powder be such that the powder will appear to float if a pinch of the powder is sprinkled in the air. In general, the cross-linking compounds available tend to be somewhat coarse, and it is preferred that they should be milled further before use.

There is no particular restriction on the nature of the cross-linker, provided that it can form a suitably fine powder for use in accordance with the process of the invention. Suitable cross-linkers may be those that form a gel with water, and examples include such compounds as gum arabic, starch, cellulose, hydroxypropyl cellulose, but especially carboxymethyl cellulose. This last is especially preferred where the end product is to comprise cellulose fibers.

It will be appreciated that the nature of the cross-linker will affect the properties of the end product. Such properties include the quantity of liquid which can be absorbed, as well as the rate at which the liquid is absorbed.

The materials produced in accordance with the present invention tend to have considerably superior absorptive qualities and, for example, a material which comprises essentially cellulose fibers and carboxymethyl cellulose (CMC) as cross-linker can absorb up to about 2,000 times its dry weight.

In the example given above, the rate of absorption tends to be extremely rapid (as little as a few seconds), and this may not always be desirable. If the material is to be used for a burn, for example, where the exudate only emerges slowly, then it may be desirable to tailor the material such that, while the overall capacity for absorbing liquid is substantially unchanged, the rate at which it will absorb the liquid is considerably reduced. Again, in the above example, this is suitably achieved with the addition of hydroxypropyl cellulose to the CMC. A proportion of about 10% hydroxypropyl cellulose to 90% CMC is generally suitable to slow the rate of absorption down such that capacity is only reached after about 24 to 48 hours.

It may also be desirable to provide a blend of substances to form the cross-linker for other reasons. In particular, while CMC is a particularly good absorptive agent, its cross-linking strength is not necessarily particularly high. A material comprising solely CMC and cellulose will hold together, even at full water capacity, but can fairly readily be broken up.

Thus, if required, a further substance can be introduced into the cross-linker powder, or pulve, to enhance the strength of the material. Again, the substance should be finely milled, and does not need to be able to provide an absorbent matrix in its own right. Suitable substances include low density thermoplastics, such as polyethylenes. These may be used in any suitable quantity, but the higher the proportion of the strengthening cross-linker, the lower the final absorptive capacity of the end product will be. A suitable range of strengthening cross-linker in the powder is between about 10% and 30%, with about 20% being preferred. When the layer is heated and compressed, the cross-linking will occur.

After the absorbent material has been prepared, it may be packaged in any suitable manner, or prepared as a dressing or nappy etc. It may be useful, for example, to provide back and front layers on the resulting sheet material, where the back layer is essentially a barrier to the passage of any liquid absorbed by the material, while the front layer is porous to allow liquid to be taken up. This is a particularly preferred embodiment, and is broadly applicable to most applications in which the materials of the invention can be used.

If the materials of the invention are to be applied as a dressing for a wound, for example, then adhesive may be applied to one face of the material, or to the porous layer which would separate the wound from the absorbent material.

It will also usually be preferable to seal the edges of the material to prevent any leakage of liquid out of the side of the product, and this may be achieved in any known manner, such as by the use of a binder or sealant. One method may involve stitching along the edge followed by sealing the stitching, if required, by a suitable sealant.

Suitable non-limiting examples of uses to which the materials of the invention may be put include: surgical sponges; incontinence pads; pledgers; eye pads; plasters; adhesive surgical dressings; impregnated wound dressings; ischaemic ulcer dressings; decubitus ulcer dressings; burn dressings; emergency accident packs; haemostatic dressings and, generally, human or animal applications.

It will also be appreciated that the absorbent materials of the invention may be employed in industrial situations, and may also useful provide insulation.

The materials of the invention may be defined as follows: an absorbent material comprising fibers cross-linked by a suitable cross-linker, characterized in that the cross-linker is associated with substantially the entire surface of each fiber.

More preferably, the materials of the invention comprise fibers cross-linked by a polyhydric cellulose derivative, and preferred cross-linkers comprise at least 50% carboxymethyl cellulose. It is most preferred that the fibers comprise natural structural polymers, the most preferred being cellulose.

The accompanying example is intended for illustration only.

EXAMPLE

ABSORBENT MATRIX

The components of the absorbent matrix are:

1. Cellulose fibers (CF), staple length 0.3 to 0.5 mm;
2. Carboxymethyl cellulose (CMC) milled to pulve; and
3. LDPE Granules milled to pulve.

The constituents are:

100 g CF;

250 g Blanose CMC (BL); and 150 g LDPE granules milled to pulve.

Ten grammes of fine cellulosic fibers, staple length 0.3 mm, are placed in a hexagonal chamber, preferably made from polypropylene, polyethylene or nylon. The chamber is rotated on a long axis mechanically at speeds between 25 and 45 revolutions per minute, depending on the size of the chamber. In this example the chamber is 20 inches high, 10 inches in diameter and bottle shaped (Bench technique). The rotation agitates the fibers and creates an electrostatic charge to the fibers. The charged fibers are tested at intervals by stopping the rotation and placing a 20 inch plastic rod in the container, to see if the fibers are attracted to it. If they are attracted en masse, a few more minutes of agitation is required before the second phase is employed. The procedure usually takes between 10 and 15 minutes, but is very dependent on the surrounding environment and it may be necessary to introduce warm dry air into the chamber to speed the process.

When the fibers are judged to be correct in terms of the charge they are holding, 25–30 g of very finely ground carboxymethylcellulose (pulve) is introduced into the chamber, preferably through a very fine sieve, so as to form clouds of pulve in the chamber. The rotation is then started again between 5 and 10 revolutions per minute. The CMC pulve is attracted to the charged fibers after approx. 5 minutes, depending on thickness of coating required (different thicknesses of coating are used for different product requirements).

When the fibers are sufficiently coated for the product required, the agitation is stopped and the coated fibers are allowed to settle on a Teflon (Trade Mark) coated fine wire mesh positioned 0.5 inch (13 mm) above a metal alloy tray inserted through an aperture at the bottom of the chamber. The coated fibers are collected on the wire mesh and the unused pulve is allowed to pass through and is collected on the tray beneath. The chamber may need to be earthed to prevent the fibers from clinging to the interior.

The wire mesh is then removed with the fibers from the chamber and gently agitated so that the fibers lie flat on the mesh. A duplicate fine wire mesh is then gently laid on the exposed fibers, to sandwich them. The sandwich is then passed through a pair of preheated Teflon (Trade Mark) coated rollers, to effect cross-linking. The fine wire mesh is then removed from the fibers to leave a pad of material.

Thickness may be gauged by the weight of the fibers and CMC pulve introduced into the chamber. The rollers may be heated electronically to produce variable heat for different thicknesses. The temperatures required are usually between 300° F. and 400° F. (149° and 204° C.). Roller pressures are between 10 and 20 lb per square inch, speed of rollers is between 45 seconds and 60 seconds per square yard.

If necessary, the cellulose fibers may be positively charged and CMC negatively charged, thereby speeding the process and producing a better base material.

What is claimed is:

1. Apparatus for the production of absorbent materials from an essentially dry preparation of fibers and an essentially dry preparation of a powdered, heat activatable compound for said fibers, said apparatus comprising a drum having a top, a bottom and walls defining a cavity of said drum;

said top of said drum having a first at least one opening through which said fibers can be introduced;

said top of said drum having a second at least one opening through which said heat activatable compound can be introduced;

dividing means being located between said first and said second openings, said dividing means extending toward said bottom of said drum;

electrical charging means being provided on said wall of said drum at a position below said first at least one opening and above the lowest extent of said dividing means;

means for introducing gas under pressure being provided on said wall of said drum at a position below said first at least one opening and above the lowest extent of said dividing means;

means to disperse said heat activatable compound and said fibers to form a dispersion when said heat activatable compound falls below the lowest extent of said dividing means;

said bottom of said drum defining an opening through which said dispersion can pass;

a fine mesh conveyor being located beneath said bottom of said drum to collect said dispersion;

collecting means being disposed beneath said conveyor to collect any excess heat activatable compound falling through said conveyor;

means to heat said dispersion after collection on said conveyor; and means to compress said dispersion after collection on said conveyor.

* * * * *